US010848869B2

(12) United States Patent
Laitinen et al.

(10) Patent No.: US 10,848,869 B2
(45) Date of Patent: Nov. 24, 2020

(54) REPRODUCTION OF PARAMETRIC SPATIAL AUDIO USING A SOUNDBAR

(71) Applicant: Nokia Technologies Oy, Espoo (FI)

(72) Inventors: Mikko-Ville Ilari Laitinen, Helsinki (FI); Miikka Vilermo, Siuro (FI); Arto Lehtiniemi, Lempaala (FI); Sujeet Mate, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/556,425

(22) Filed: Aug. 30, 2019

(65) Prior Publication Data

US 2020/0077191 A1 Mar. 5, 2020

Related U.S. Application Data

(60) Provisional application No. 62/724,708, filed on Aug. 30, 2018.

(51) Int. Cl.
*H04R 5/02* (2006.01)
*H04R 3/12* (2006.01)

(52) U.S. Cl.
CPC ..... *H04R 5/02* (2013.01); *H04R 3/12* (2013.01); *H04R 2203/12* (2013.01)

(58) Field of Classification Search
CPC ..... H04R 2203/12; H04R 3/12; H04R 5/02; H04R 1/403; H04R 2201/403; H04S 2420/03; H04S 7/302; H04S 7/305
USPC ..... 381/300
See application file for complete search history.

(56) References Cited

U.S. PATENT DOCUMENTS 9,093,063 B2 * 7/2015 Vilkamo ..... G10L 19/008
9,774,976 B1 * 9/2017 Baumgarte ..... H04S 7/305
9,794,718 B2 * 10/2017 Crockett ..... H04R 5/02
10,210,881 B2 * 2/2019 Eronen ..... G10L 19/167
(Continued)

FOREIGN PATENT DOCUMENTS

EP 2 733 965 A1 5/2014

OTHER PUBLICATIONS

Kowalczyk, Konrad, et al., "Parametric Spatial Sound Processing: A flexible and efficient solution to sound scene acquisition, modification, and reproduction", IEEE Signal Processing Magazine, vol. 32, No. 2, Mar. 2015, pp. 31-42.
(Continued)

*Primary Examiner* — Khai N. Nguyen
(74) *Attorney, Agent, or Firm* — Harrington & Smith

(57) ABSTRACT

Method, apparatus and computer program product of direct reproduction/rendering of parametric spatial audio with sound-field related parametrization using a soundbar. The parametric spatial audio is reproduced directly with the soundbar without intermediate formats. Positioning of the audio is performed directly based on metadata associated with audio signals. Audio signals are received, metadata associated with those signals are obtained, and the signals are divided into direct and ambient parts based on the metadata. The direct part can be reproduced using panning and beamforming. The ambience is reproduced by creating ambient beams that radiate the sound in multiple directions using reflection. As a result, the listener receives the sound via multiple reflections and perceives the sound as enveloping. The soundbar signals reproduce the direct and ambient parts by merging to produce an output.

20 Claims, 12 Drawing Sheets

Block diagram of the "spatial synthesis".

(56) References Cited

U.S. PATENT DOCUMENTS

| | | | | |
|---|---|---|---|---|
| 10,313,815 | B2 * | 6/2019 | Kuech | H04S 7/30 |
| 10,349,196 | B2 * | 7/2019 | Vilermo | H04H 60/73 |
| 2007/0067104 | A1 * | 3/2007 | Mays | G01C 21/36 701/437 |
| 2012/0314876 | A1 * | 12/2012 | Vilkamo | G10L 19/008 381/22 |
| 2013/0148812 | A1 | 6/2013 | Corteel et al. | |
| 2014/0056430 | A1 * | 2/2014 | Choi | H04S 5/00 381/17 |
| 2015/0208190 | A1 * | 7/2015 | Hooks | H04R 1/403 381/303 |
| 2015/0223002 | A1 * | 8/2015 | Mehta | H04S 7/30 381/303 |
| 2015/0249899 | A1 * | 9/2015 | Kuech | H04S 7/30 381/18 |
| 2015/0271620 | A1 * | 9/2015 | Lando | H04S 5/005 381/18 |
| 2015/0350804 | A1 * | 12/2015 | Crockett | H04R 5/02 381/307 |
| 2016/0073215 | A1 | 3/2016 | De Bruijn et al. | |
| 2016/0210957 | A1 * | 7/2016 | Stefanakis | H04R 3/005 |
| 2017/0374484 | A1 * | 12/2017 | Lando | G10L 19/008 |
| 2018/0020310 | A1 * | 1/2018 | Crockett | H04R 5/02 |
| 2018/0033447 | A1 * | 2/2018 | Ramprashad | G10L 21/028 |
| 2018/0082700 | A1 * | 3/2018 | Eronen | G10L 19/167 |
| 2018/0084367 | A1 * | 3/2018 | Greff | G10L 19/02 |
| 2018/0096705 | A1 * | 4/2018 | Vilermo | H04S 3/008 |
| 2018/0103316 | A1 | 4/2018 | Faller et al. | 1/403 |
| 2018/0242077 | A1 * | 8/2018 | Smithers | H04R 1/025 |
| 2019/0005970 | A1 * | 1/2019 | Atti | G10L 21/038 |
| 2019/0028803 | A1 * | 1/2019 | Benattar | H04R 1/406 |
| 2019/0394606 | A1 * | 12/2019 | Tammi | H04R 3/005 |
| 2020/0045419 | A1 * | 2/2020 | Bohmer | H04S 7/305 |

OTHER PUBLICATIONS

Pulkki, Ville, "Spatial Sound Reproduction with Directional Audio Coding", J. Audio Eng. Soc., vol. 55, pp. 503-516, Jun. 2007.

Farina, Angelo, et al., "A Spherical Microphone Array for Synthesizing Virtual Directive Microphones in Live Broadcasting and in Post Production", AES 40th International Conference, 11 pgs., Oct. 2010.

He, Jianjun, "Spatial Audio Reproduction Using Primary Ambient Extraction", School of Electrical &Electronic Engineering, Thesis, Nanyang Technological University, 248 pgs., 2016.

Politis, Archontis, et al., "Parametric Spatial Audio Processing of Spaced Microphone Array Recordings for Multichannel Reproduction", Journal of the Audio Engineering Society, vol. 63, No. 4, pp. 216-227, Apr. 2015.

* cited by examiner

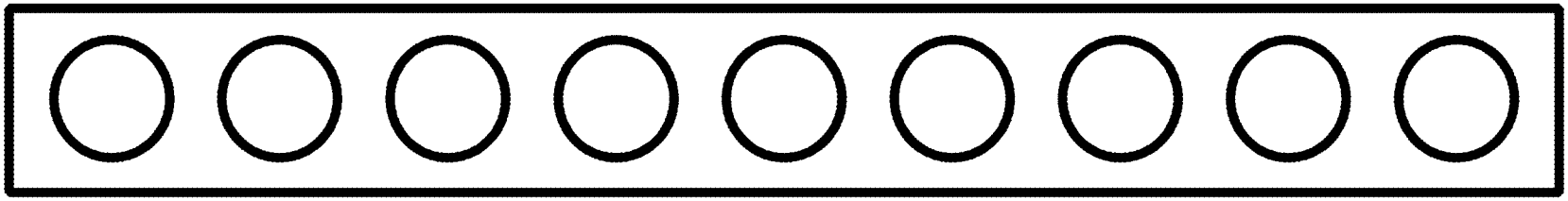
FIG. 1: Example of a soundbar with 9 drivers.

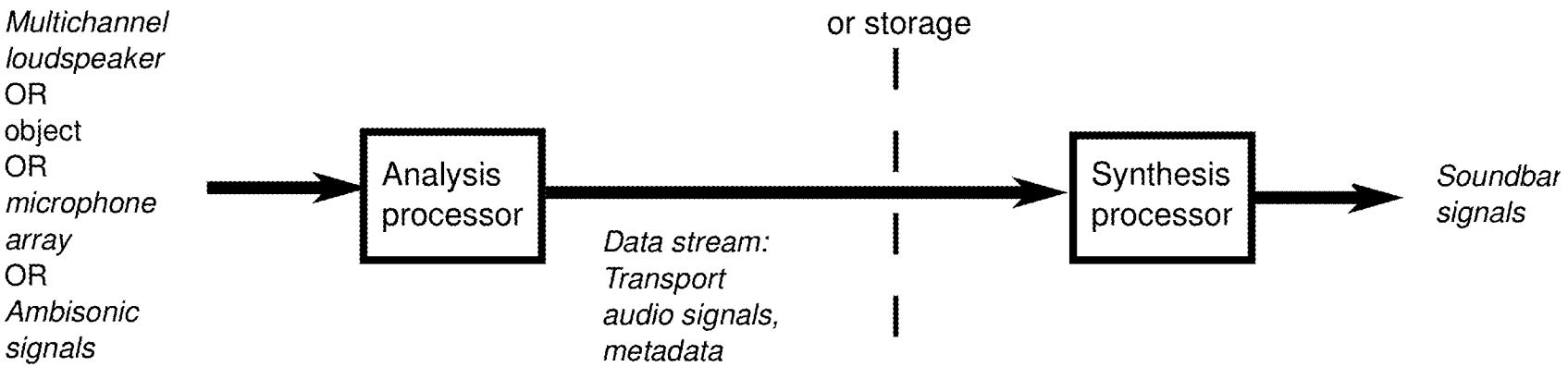
FIG. 2: Block diagram of an example of a system.

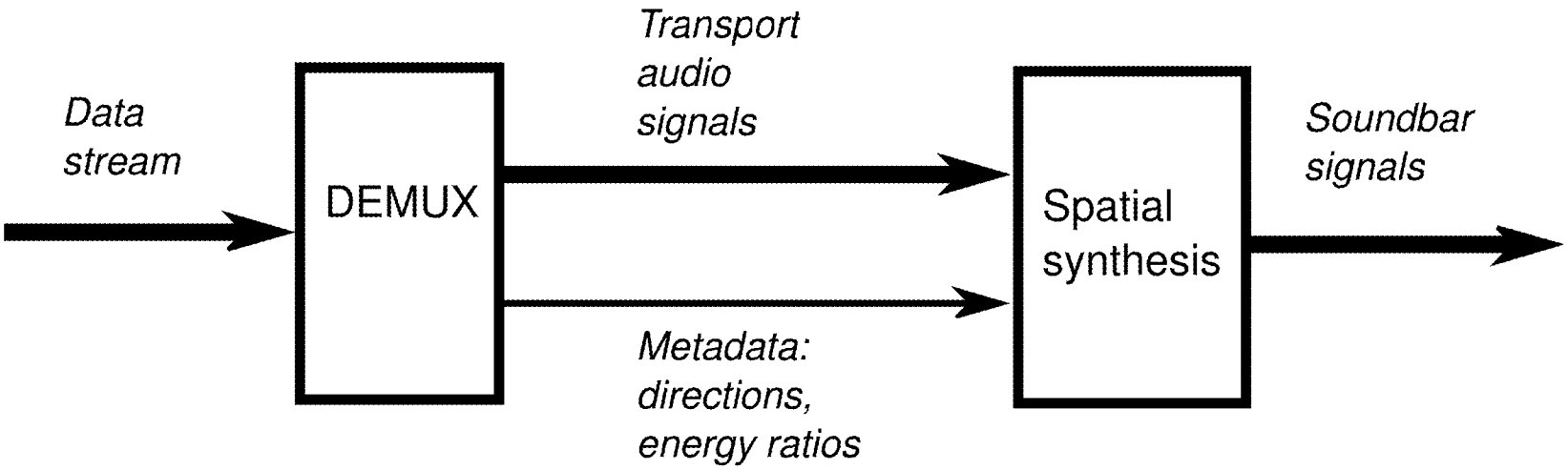
FIG. 3: Block diagram of the "synthesis processor".

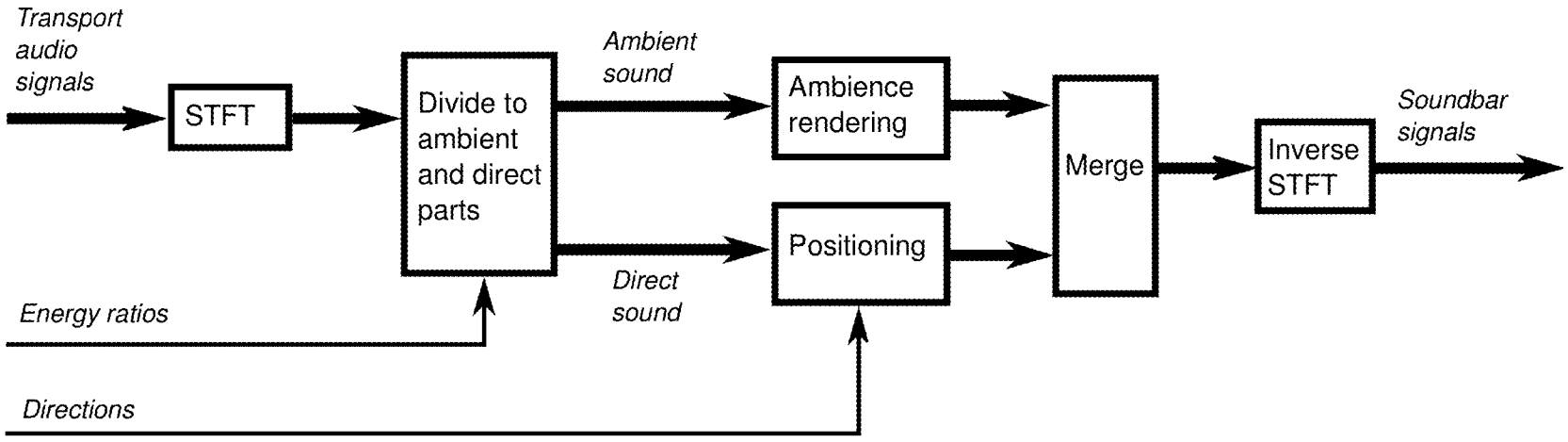
FIG. 4: Block diagram of the "spatial synthesis".

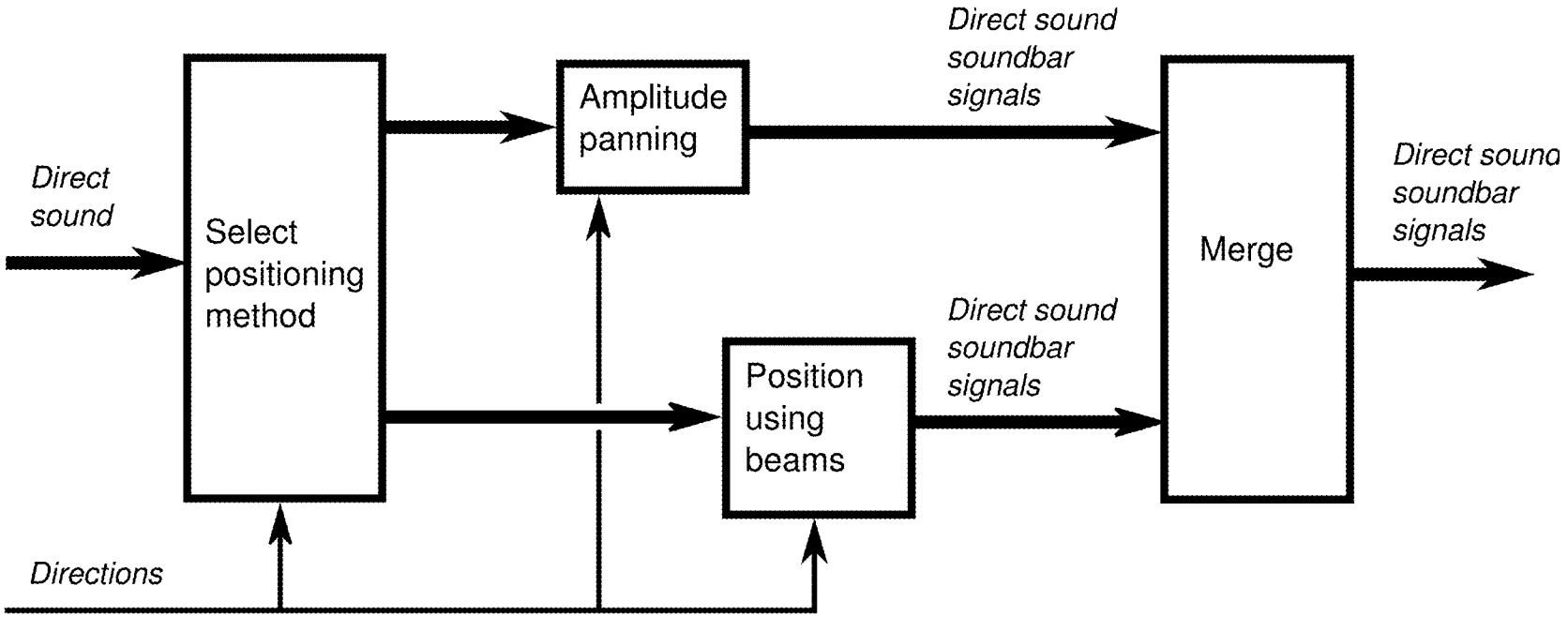
FIG. 5: Block diagram of the "positioning" block.

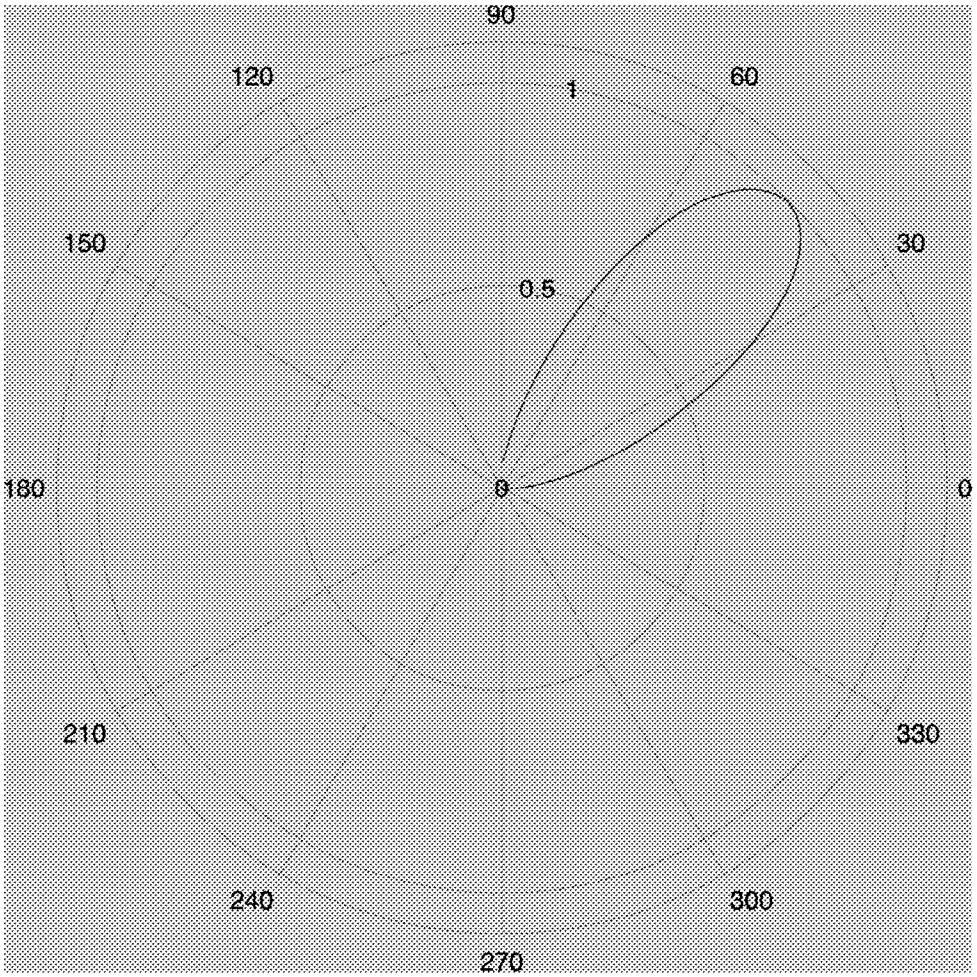
FIG. 6: Example of a beam for direct sound positioning, where only the front side (-90° to +90°) is depicted.

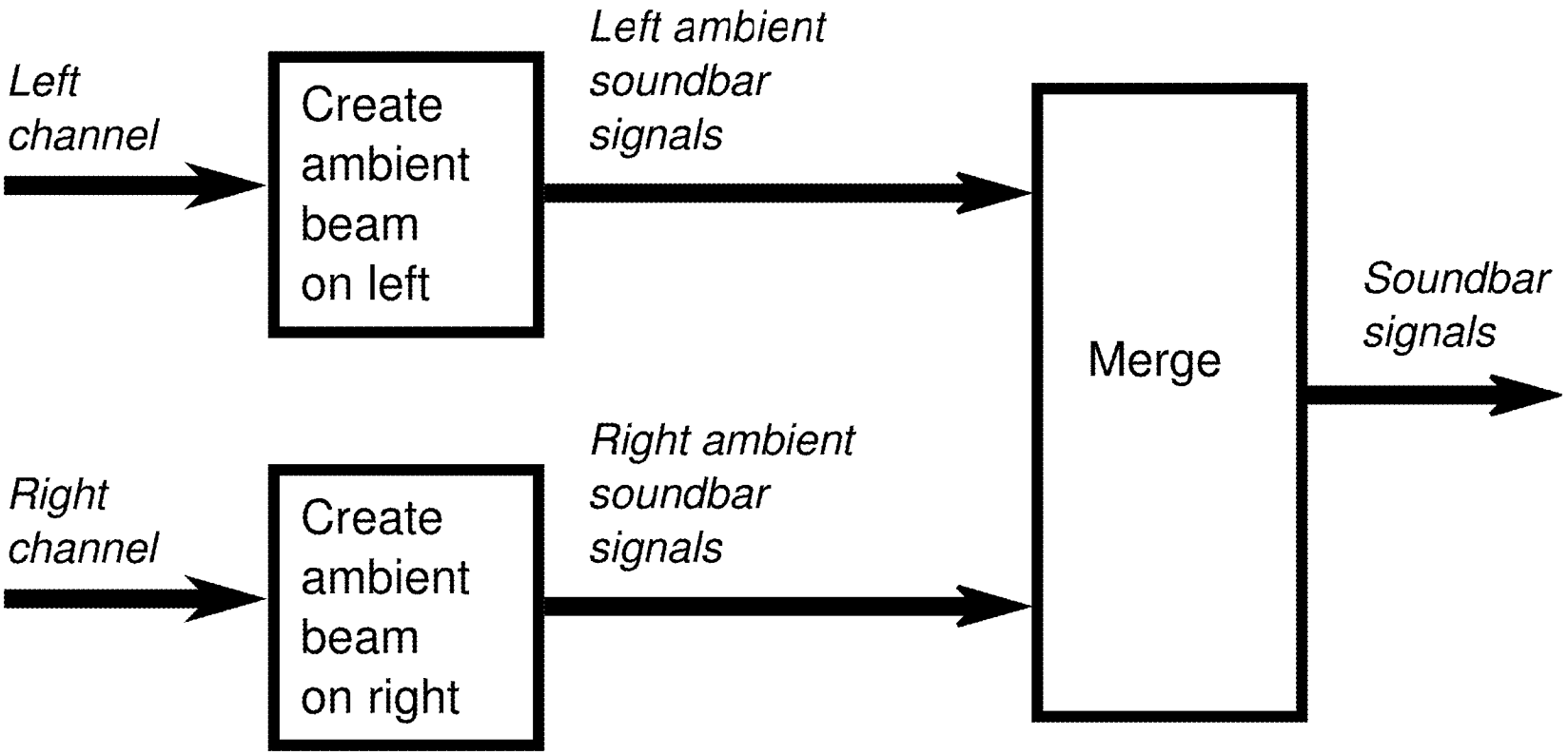
FIG. 7: Block diagram of the "ambience rendering" block.

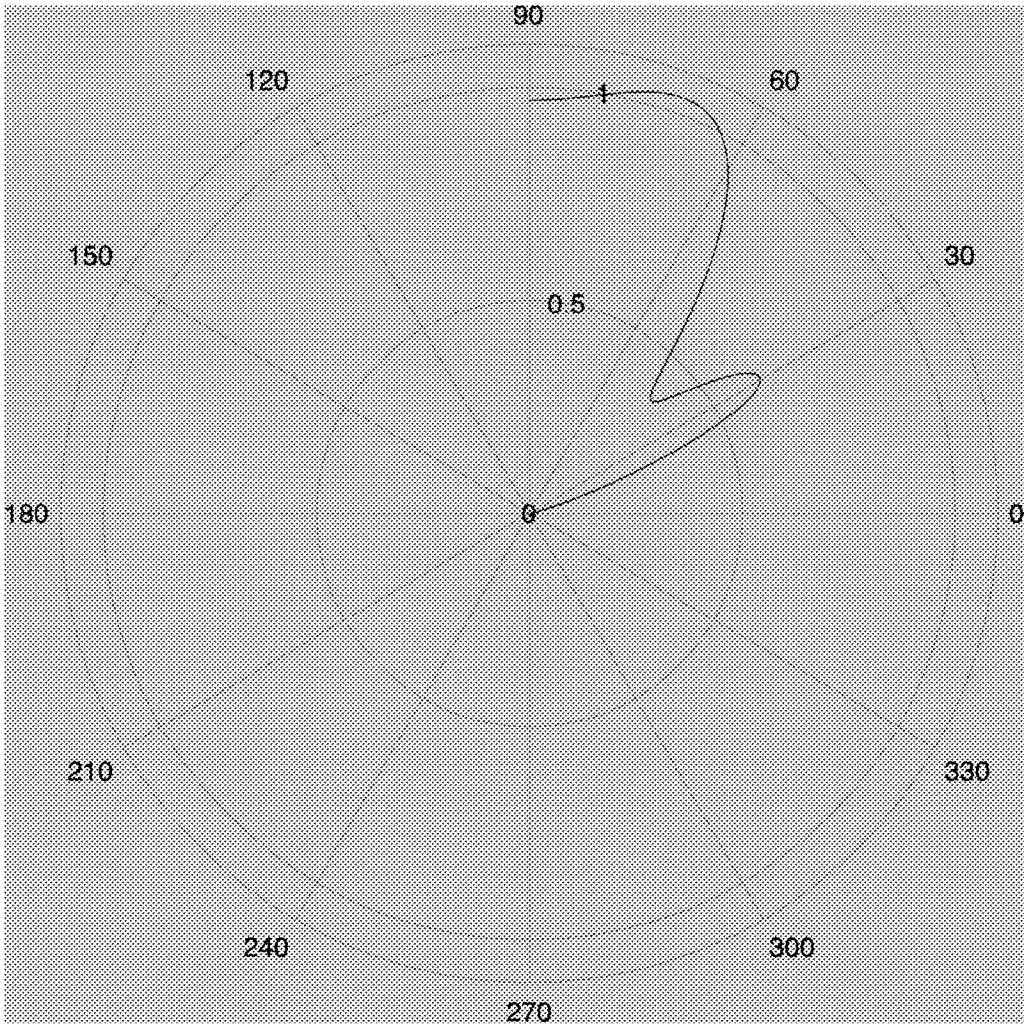
FIG. 8: Example of a beam for ambient sound rendering, where only the front side (-90° to +90°) is depicted.

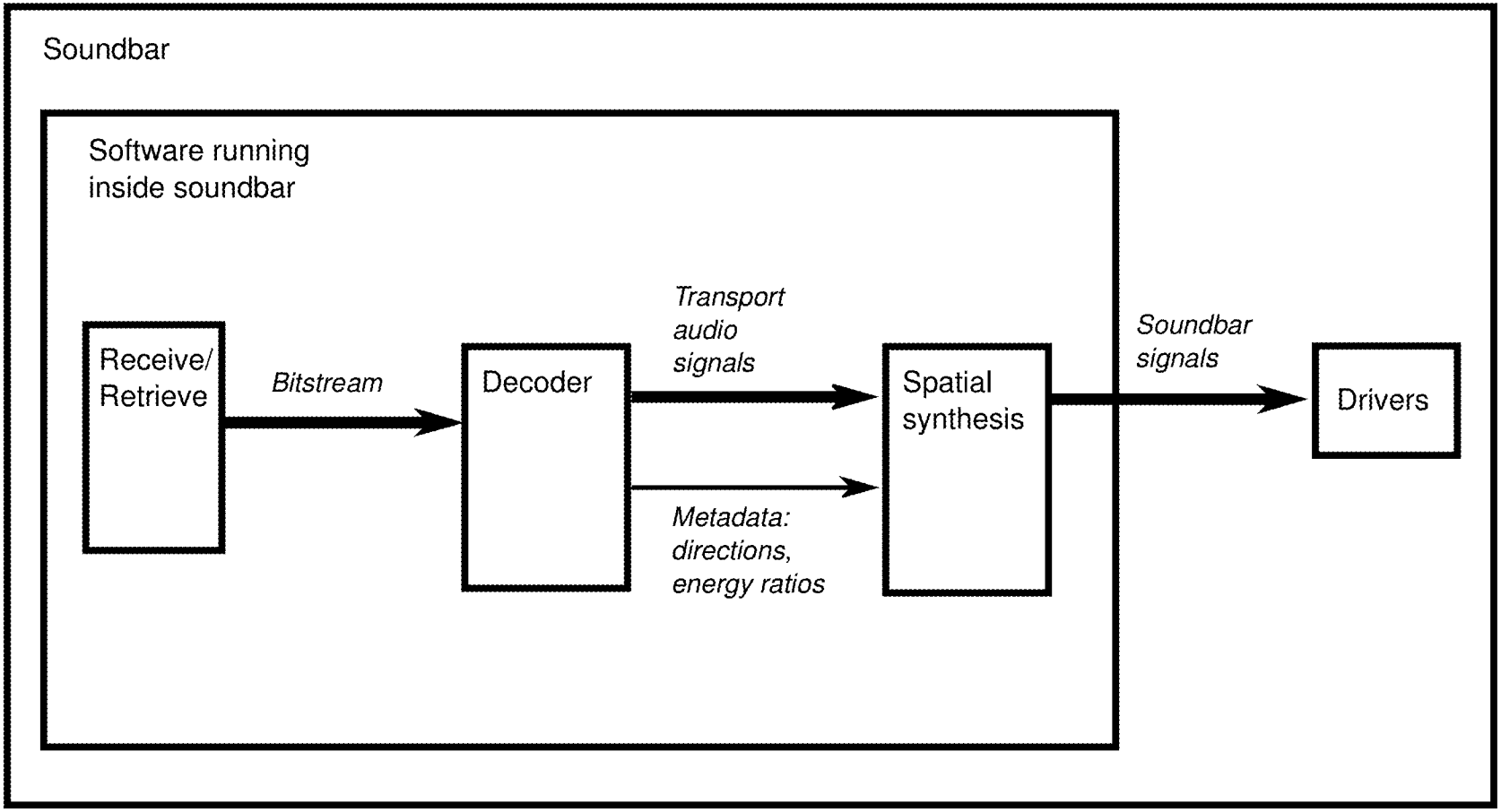
FIG. 9: Block diagram of an example of an embodiment of the present invention.

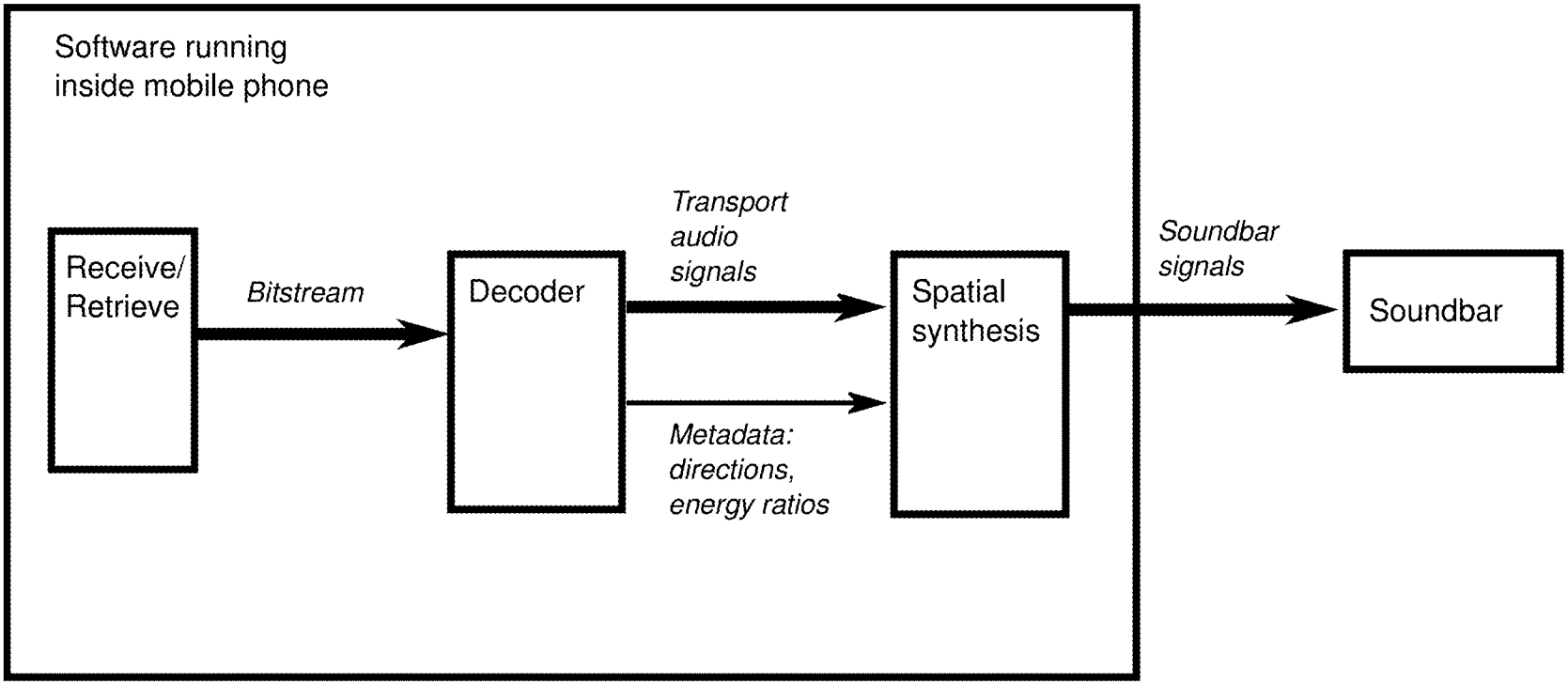
FIG. 10: Block diagram of another example of an embodiment of the present invention.

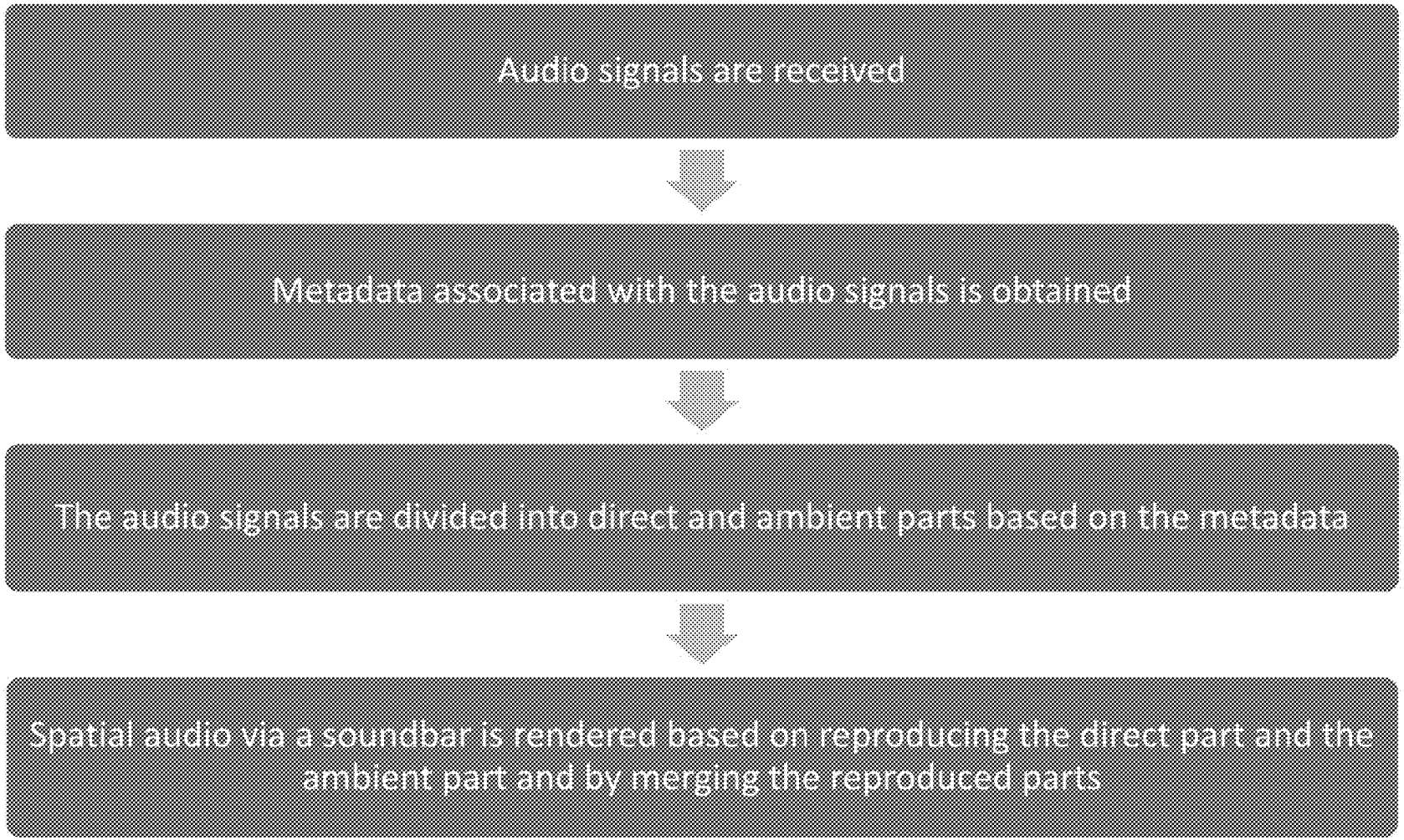
FIG. 11: a logic flow diagram of an exemplary method

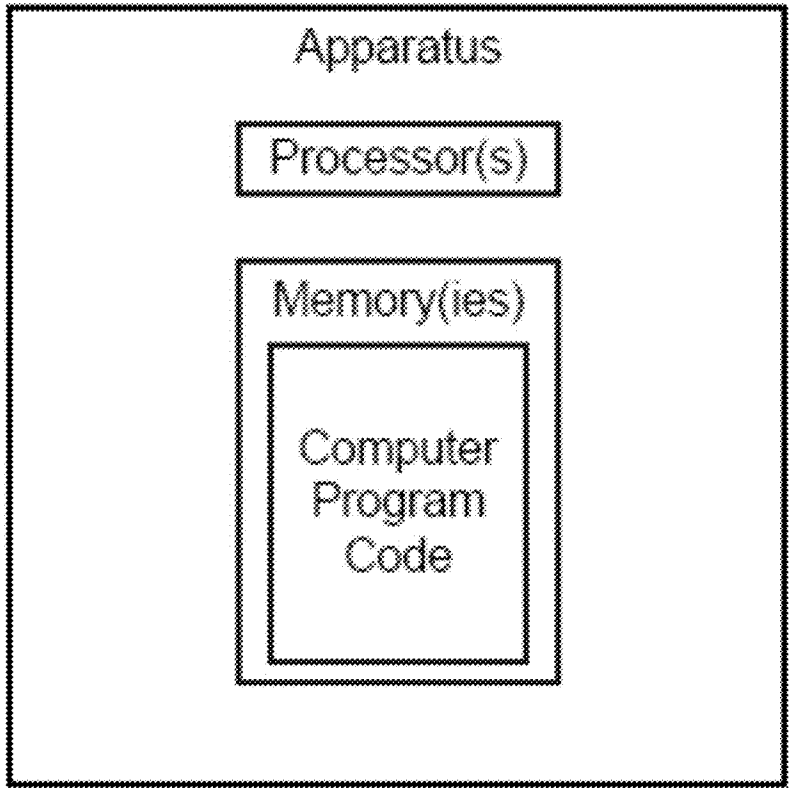
FIG. 12: An exemplary apparatus.

REPRODUCTION OF PARAMETRIC SPATIAL AUDIO USING A SOUNDBAR

CROSS-REFERENCE TO RELATED APPLICATION

The present application claims the benefit under 35 U.S.C. § 119(e) of U.S. Provisional Patent Application No. 62/724,708, filed on Aug. 30, 2018, the disclosure of which is hereby incorporated by reference in its entirety.

TECHNICAL FIELD

This invention relates generally to reproduction of spatial audio using a soundbar and, in particular, the invention focuses on the reproduction of parametric spatial audio.

BACKGROUND

This section is intended to provide a background or context to the invention disclosed below. The description herein may include concepts that could be pursued, but are not necessarily ones that have been previously conceived, implemented, or described. Therefore, unless otherwise explicitly indicated herein, what is described in this section is not prior art to the description in this application and is not admitted to be prior art by inclusion in this section.

Spatial audio may be captured using, for instance, mobile phones or virtual-reality cameras. For such devices (or microphone arrays in general), it is an option to utilize parametric spatial audio capture methods to enable a perceptually accurate spatial sound reproduction.

Parametric spatial audio capture refers to adaptive DSP-driven audio capture methods. Specifically, it typically means (1) analyzing perceptually relevant parameters in frequency bands, for example, the directionality of the propagating sound at the recording position, and (2) reproducing spatial sound in a perceptual sense at the rendering side according to the estimated spatial parameters. The reproduction can be, for example, for headphones or multichannel loudspeaker setups.

By estimating and reproducing the perceptually relevant spatial properties (parameters) of the sound field, a spatial perception similar to that which would occur in the original sound field can be reproduced. As the result, the listener can perceive the multitude of sources, their directions and distances, as well as properties of the surrounding physical space, among the other spatial sound features, as if the listener was in the position of the capture device.

Binaural spatial-audio-reproduction estimates the directions of arrival (DOA) and the relative energies of the direct and ambient components, expressed as direct-to-total energy ratios, from the microphone signals in frequency bands, and synthesizes either binaural signals for headphone listening or multi-channel loudspeaker signals for loudspeaker listening. Similar parametrization may also be used for the compression of spatial audio, such as the parameters being estimated from the input loudspeaker signals and the estimated parameters being transmitted alongside a downmix of the input loudspeaker signals.

In general, parametric spatial audio processing can be defined as: (1) Analyzing certain spatial parameters using audio signals (e.g., microphone or multichannel loudspeaker signals); and (2) Synthesizing spatial sound (e.g., binaural or multichannel loudspeaker) using the analyzed parameters and associated audio signals. The spatial parameters may include for instance: (1) Direction parameter (azimuth, elevation) in time-frequency domain; and (2) Direct-to-total energy ratio in time-frequency domain.

This kind of parametrization will be denoted as sound-field related parametrization in the following text. Using exactly the direction and the direct-to-total energy ratio will be denoted as direction-ratio parameterization in the following. Also other parameters may be used instead/in addition to these (e.g., diffuseness instead of direct-to-total-energy ratio, and adding distance).

Regarding soundbars, soundbars are types of loudspeaker that typically have a multitude of drivers in a wide box. The advantage of a soundbar is that it can reproduce spatial sound using a single box that can, for instance, be placed under the television screen, whereas, for example, a 5.1 loudspeaker system requires placing several loudspeaker units around the listening position.

Typical soundbars take multichannel loudspeaker signals (e.g., 5.1) as an input. As there are no loudspeakers on the sides or behind the listener, specific signal processing is needed to produce the perception of sound appearing from these directions. Techniques such as beamforming may be used to produce the perception of sound coming from sides or behind.

Beamforming uses a multitude of drivers to create a certain beam pattern to a particular direction. By doing so, the sound can, for instance, be concentrated to be radiated prominently only to a side wall, from where the sound reflects to the listener. As a result, the level of sound coming to the listener from the side reflection is significantly higher than the sound coming directly from the soundbar. This is perceived as the sound coming from the side.

There are many variations to this, and many kinds of implementations, but as a generic basic idea typically beamforming is being used to reproduce sound to the listener via walls.

In the case of 5.1 input, the soundbar may, for instance, reproduce the front left, right, and center channels directly using the drivers of the soundbar (e.g., the leftmost driver for the left channel, the center driver for the center channel, and the rightmost driver for the right channel). The side left and right channels may, for instance, be reproduced by creating a beam to certain directions on the side walls so that the listener perceives the sound to originate from that direction. The same principle can be extended to any loudspeaker setup, e.g., 7.1. Furthermore, beamforming may also be used when reproducing the front channels in order to have more spaciousness.

Another approach for soundbars may be to use cross-talk cancellation techniques. These are based on cancelling recursively cross-talk from each driver, and thus being able to get a certain signal to a certain ear, and having filtered this signal with, for example, a head-related transfer function. These methods require the listener to be positioned exactly in a certain position.

Previous writings that may be useful as background to the current invention may include V. Pulkki, "Spatial Sound Reproduction with Directional Audio Coding," J. Audio Eng. Soc., vol. 55, pp. 503-516 (2007 June) and Farina, A., Capra, A., Chiesi, L., and Scopece, L. (2010) "A spherical microphone array for synthesizing virtual directive microphones in live broadcasting and in post-production," in 40th International Conference of AES, Tokyo, Japan.

The current invention moves beyond these techniques.

Acronyms or abbreviations that may be found in the specification and/or the drawing figures are defined within the context of this disclosure or as follows below:

AAC Advance audio coding
A/D Analog to Digital
ASIC Application-Specific Integrated Circuit
D/A Digital to Analog
DEMUX Demultiplexer
DSP Digital Signal Processor/Digital Signal Processing
EVS Enhanced voice services
FPGA Field-programmable gate array
HOA Higher-order Ambisonics
LFE Low-frequency effects
SPAC Spatial audio capture

BRIEF SUMMARY

This section is intended to include examples and is not intended to be limiting. The word "exemplary" as used herein means "serving as an example, instance, or illustration." Any embodiment described herein as "exemplary" is not necessarily to be construed as preferred or advantageous over other embodiments. All of the embodiments described in this Detailed Description are exemplary embodiments provided to enable persons skilled in the art to make or use the invention and not to limit the scope of the invention which is defined by the claims.

Disclosed is a method of direct reproduction/rendering of parametric spatial audio with sound-field related parametrization using a soundbar. The parametric spatial audio is reproduced directly with the soundbar without intermediate formats (e.g. 5.1 multi-channel). Positioning of the audio is performed directly based on the spatial metadata. Spatial metadata (e.g. direction and energy ratios parameters) associated with audio signals are obtained. The metadata comprises spatial audio related parameters, e.g., directions, energy ratios etc.

The audio signals are divided into direct and ambient parts based on the energy ratio parameter. As such, the division is based on the direct-to-total energy ratio metadata or derived from the direction metadata. In either case, the division is performed based on the metadata.

The direct part is reproduced using amplitude panning and beamforming (utilizing reflections from walls) based on the direction parameter. In front, the positioning is realized by amplitude panning between the drivers of the soundbar. In the sides and back, the positioning is realized by forming beams towards the walls and bouncing the sound via the walls to the listener. The beams are formed to certain directions where the sound is reflected to the listener using few reflections. The sound is positioned by interpolating between these beams and/or by quantizing the direction parameters to these directions. Thus, additional panning to the intermediate format is avoided and more accurate positioning is provided. Moreover, the technique used could be also something else than amplitude panning, such as ambisonics panning, or delay panning, or anything that can position the audio.

The ambience is reproduced by creating ambient beams that radiate the sound to other directions than the direction of the listener. As a result, the listener receives the sound via multiple reflections and perceives the sound as enveloping. If there are multiple obtained audio signals, then there is a different beam for each signal in order to increase the envelopment even further (for the left channel, create a beam towards left, and for the right channel, create a beam towards right). As the sound is reproduced to the listener via multiple reflections as reverberation, there is no need for decorrelation which is typically required with the intermediate formats. Hence, artefacts related to decorrelation are avoided. Finally, the soundbar signals (reproduced direct part and ambient part) from the amplitude panning and the beam-based positioning are merged to output the resulting signals.

An example of an embodiment of the current invention is a method comprising: receiving audio signals; obtaining metadata associated with the audio signals; dividing the audio signals into direct and ambient parts based on the metadata; and rendering spatial audio via a soundbar based on reproducing the direct part and the ambient part and by merging the reproduced parts.

An example of a further embodiment of the current invention is an apparatus comprising: at least one processor and at least one memory including computer program code, wherein the at least one memory and the computer code are configured, with the at least one processor, to cause the apparatus to at least perform the following: receiving audio signals; obtaining metadata associated with the audio signals; dividing the audio signals into direct and ambient parts based on the metadata; and rendering spatial audio via a soundbar based on reproducing the direct part and the ambient part and by merging the reproduced parts.

An example of yet another embodiment of the current invention is a computer program product embodied on a non-transitory computer-readable medium in which a computer program is stored that, when being executed by a computer, is configured to provide instructions to control or carry out: receiving audio signals; obtaining metadata associated with the audio signals; dividing the audio signals into direct and ambient parts based on the metadata; and rendering spatial audio via a soundbar based on reproducing the direct part and the ambient part and by merging the reproduced parts.

An example of yet another embodiment of the current invention is a computer program product embodied on a non-transitory computer-readable medium in which a computer program is stored that, when being executed by a computer, is configured to provide instructions comprising code for receiving audio signals; code for obtaining metadata associated with the audio signals; code for dividing the audio signals into direct and ambient parts based on the metadata; and code for rendering spatial audio via a soundbar based on reproducing the direct part and the ambient part and by merging the reproduced parts.

An example of a still further embodiment of the present invention is an apparatus comprising means for receiving audio signals; means for obtaining metadata associated with the audio signals; means for dividing the audio signals into direct and ambient parts based on the metadata; and means for rendering spatial audio via a soundbar based on reproducing the direct part and the ambient part and by merging the reproduced parts.

BRIEF DESCRIPTION OF THE DRAWINGS

In the attached Drawing Figures:

FIG. 1 is a block diagram of an exemplary soundbar with 9 drivers;

FIG. 2 is a block diagram of an exemplary system in which the exemplary embodiments may be practiced;

FIG. 3 is a block diagram of the "synthesis processor" of the present invention, where details of "spatial synthesis" are shown in FIG. 4;

FIG. 4 is a block diagram of the "spatial synthesis" of the present invention, where details of "positioning" are shown in FIG. 5. and details of "ambience rendering" are shown in FIG. 7;

FIG. 5 is a block diagram of the "positioning" block of FIG. 4;

FIG. 6 is a schematic example of a beam for direct sound positioning, where only the front side (−90° to +90°) is depicted;

FIG. 7 is a block diagram of the "ambience rendering" block of FIG. 4;

FIG. 8 is a schematic example of a beam for ambient sound rendering, where only the front side (−90° to +90°) is depicted FIG. 9 is a block diagram of an exemplary system in which the exemplary embodiments may be practiced;

FIG. 10 is a block diagram of another exemplary system in which the exemplary embodiments may be practiced;

FIG. 11 is a logic flow diagram an exemplary method, a result of execution of computer program instructions embodied on a computer readable memory, functions performed by logic implemented in hardware, and/or interconnected means for performing functions in accordance with exemplary embodiment; and FIG. 12 is a block diagram of an exemplary apparatus in accordance with an exemplary embodiment.

DETAILED DESCRIPTION OF THE DRAWINGS

The word "exemplary" is used herein to mean "serving as an example, instance, or illustration." Any embodiment described herein as "exemplary" is not necessarily to be construed as preferred or advantageous over other embodiments. All of the embodiments described in this Detailed Description are exemplary embodiments provided to enable persons skilled in the art to make or use the invention and not to limit the scope of the invention which is defined by the claims.

As the cross-talk cancellation approaches are assumed to be less common, and this invention report focuses on the soundbars utilizing beamforming. Nevertheless, the methods proposed in this invention are equally usable with soundbars using cross-talk cancellation. Moreover, there may also be other type of soundbars. However, it is assumed that the methods proposed herein are valid also in these cases.

As mentioned above, the parametric spatial audio methods can be used to reproduce sound via multichannel loudspeaker setups and headphones, but soundbar reproduction has not been considered. An option is to render the parametric spatial audio to, 5.1 format for instance, and to use the standard 5.1 processing of the soundbar. However, it is claimed that this does not produce the optimal quality, but instead, this intermediate transformation to 5.1 is harming the reproduced audio quality.

An aim of the present invention is to propose methods that can be used to directly reproduce parametric spatial audio using a soundbar. It is claimed that optimal audio quality can be obtained this way.

The methods proposed herein can be extended from soundbars to any loudspeaker arrays with multiple loudspeakers (or drivers) in known positions. However, it is assumed that soundbars are the most practical implementation for the proposed methods, as the locations of the drivers are fixed and known (in relation to each other) in soundbars. Hence, the term "soundbar" is being used in the following text to denote any loudspeaker array with drivers in known positions. Typically, the drivers, however, are only on the one side of the listener.

Soundbars (or soundbar-like loudspeaker arrays) typically have drivers only on the one side of the listener (for example, in actual soundbars all the drivers are inside one box). Hence, conventional methods (such as amplitude panning) for positioning sound around the listener cannot be used. Moreover, ambience cannot be reproduced using conventional methods (e.g., decorrelated audio from multiple locations around the listener) as there are no loudspeakers around the listener.

Thus, specific methods are needed for rendering of spatial audio using soundbars. However, such methods have not been proposed for rendering of spatial audio with sound-field related parametrization.

An option is to use an intermediate channel-based format, such as 7.1 multichannel signals (i.e., rendering the parametric spatial audio to 7.1 loudspeaker signals and rendering the 7.1 signals with a soundbar). 7.1 loudspeaker layout (loudspeakers at ±30, 0, ±90, and ±150 degrees, and an LFE channel) is used as an example in the following text but not a limiting example. With this approach state-of-the-art methods can be used (e.g., SPAC can be used to render the parametric spatial audio to 7.1 loudspeaker signals, and soundbars typically have capability to reproduce 7.1 loudspeaker signals). However, there are at least two problems when using such intermediate formats.

The first problem is that the directional sound needs to be first mixed to channels of the 7.1 setup and that these channels need to be rendered using the soundbar. Assume that the direction parameter (in the spatial metadata) is pointing to 120 degrees. As a result, the spatial synthesis applies amplitude panning to reproduce the sound using the loudspeakers at 90 and 150 degrees. As the soundbar does not include actual loudspeakers at these directions, it needs to create them using beamforming. The resulting virtual loudspeakers are not as point-like as actual loudspeakers. It may even be that the soundbar can position the sound only in certain directions (e.g., depending on the geometry of the room) or at least there are directions where the positioning works better than other directions. Moreover, amplitude panning may not fully work with this kind of virtual loudspeaker. Therefore, the perception of direction can be expected to be very vague. It is proposed in an exemplary embodiment of this invention that the directional accuracy can be improved in these kinds of situations by avoiding the creation of two virtual loudspeakers (and panning in between them) and, instead, creating a virtual loudspeaker directly to the correct direction (120 degrees in this case). Alternatively, the soundbar may optimize the reproduction of sound to directions which it can optimally reproduce.

The second problem is that the ambient part needs to be rendered to the channels of the 7.1 setup. As there are typically only 2 transport channels and 7 output channels, decorrelation techniques are needed in order to have incoherence between the channels and, thus, reproduce the perception of spaciousness and envelopment. This can cause deterioration of quality in some cases (e.g., speech), as decorrelation is modifying the temporal structure as well as the phase spectrum of the signal. It is proposed in this invention that the reproduction of ambience can be optimized for the soundbar reproduction in the case of parametric spatial audio input by avoiding the decorrelation.

Therefore, there is a need for specific methods for soundbars that can directly render parametric spatial audio without intermediate formats. The present invention proposes such a method.

Moreover, the present invention moves beyond currently known techniques. Regarding Pulkki, noted above, the techniques of this invention are also applicable to any method utilizing sound-field related parametrization, such as directional audio coding (DirAC). The soundbars are typically based on beamforming. Beamforming has been widely studied, and there is a massive amount of literature on the topic. The beams for sound reproduction can be designed, e.g., using the methods proposed in Farina, also noted above.

This invention goes beyond current understanding in spatial audio capture (SPAC) methods, so although previous SPAC methods have enabled reproduction with loudspeakers and headphones, soundbar reproduction has not been discussed. This invention proposes the soundbar reproduction in the context of SPAC.

Nonetheless, the inventors are not aware of direct soundbar reproduction of spatial audio with sound-field related parametrization.

The present invention relates to reproduction of parametric spatial audio (from microphone-array signals, multichannel signals, Ambisonics, and/or audio objects) where a solution is provided to improve the audio quality of soundbar reproduction of parametric spatial audio using sound-field related parametrization (e.g., direction(s) and/or ratio(s) in frequency bands) and where improvement is obtained by reproducing the parametric spatial audio directly with the soundbar without intermediate formats (such as 5.1 multichannel), the novel rendering being based on the following: obtaining direction and ratio parameters and associated audio signals; dividing the audio signals to direct and ambient parts based on the ratio parameter; reproducing the direct part using a combination of amplitude panning and beamforming (utilizing reflections from walls) based on the direction parameter; and reproducing the ambient part using a separate "ambient beam" for each obtained associated audio signal The processing is performed in the time-frequency domain.

As shown in FIG. 1, the soundbar may contain 2 or more drivers (where the figure shows an example with 9) arranged next to each other.

The direct part rendering depends on the exact type of the soundbar. As an example, the soundbar is used based on beamforming. With such a soundbar, the positioning in the front may be realized by amplitude panning between the drivers of the soundbar. In the sides and back, the positioning may be realized by forming beams towards the walls and bouncing the sound via the walls to the listener. The beams may be formed to certain directions where the sound may be reflected to the listener using only few reflections (optimally only one). The sound may be positioned by interpolating between these beams and/or by quantizing the direction parameters to these directions. In addition, amplitude-panning and beam-forming reproduction can be mixed at some directions. In any case, this invention avoids the additional panning to the intermediate format (such as 5.1 multichannel), and thus provides more accurate positioning.

The ambient part rendering depends on the exact type of the soundbar. As an example, again the soundbar is used based on beamforming. With such a soundbar, the ambience can be reproduced by creating beams (called "ambient beams" above) that radiate the sound to other directions than the direction of the listener (and potentially avoiding also first-order reflections). As a result, the listener receives the sound via (multiple) reflections, and perceives the sound as enveloping. If there are multiple obtained audio signals, there may be a different beam for each signal in order to increase the envelopment even further (for the left channel, create a beam towards left, and for the right channel, create a beam towards right). In any case, as the sound is reproduced to the listener via multiple reflections as reverberation, there is no need for decorrelation (which would typically be required with the intermediate formats, such as 5.1 multi-channel). As a result, artefacts related to decorrelation can be avoided.

FIG. 2 presents a block diagram of an example system utilizing the present invention. The input to the system can be in any format, for example, multichannel loudspeaker signals (such as 5.1), audio objects, microphone-array signals, or Ambisonic signals (of any order). The input signals are fed to an "Analysis processor".

The analysis processor can, for example, be a computer or a mobile phone (running suitable software), or alternatively a specific device utilizing, for example, FPGAs or ASICs. Based on the input audio signals, the analysis processor creates a data stream that contains transport audio signals (e.g., 2 signals, can also be any other number N) and spatial metadata (e.g., directions and energy ratios in frequency bands). The exact implementation of the analysis processor depends on the input, and there are also many methods presented in the prior art. As an example, one can use SPAC in the case of microphone-array input. The transport audio signals may be obtained, for instance, by selecting, downmixing, and/or processing the input signals. The transport audio signals may be compressed (e.g., using AAC or EVS). Correspondingly, the spatial metadata may be compressed using any suitable method. Moreover, the audio signals and the metadata may be multiplexed to a single data stream.

The data stream may be transmitted to a different device, may be stored to be reproduced later, or may be directly reproduced in the same device. In any case, the data stream is eventually fed to a "synthesis processor". The synthesis processor creates signals for the drivers of the soundbar. As this processing is dependent on the exact features of the soundbar (such as number and placing of the drivers), the synthesis processor may be implemented inside the soundbar or in a device controlling it. Alternatively, a mobile phone or a computer (running suitable software) may be used to realize it (e.g., using software or a plugin tuned for the specific soundbar). The soundbar signals are finally reproduced by the drivers of the soundbar.

FIG. 3 presents a block diagram of the "synthesis processor". As can be seen, the data stream is demultiplexed into the audio signals and the spatial metadata. If the audio signals and/or metadata were compressed, the DEMUX block would also decode them. The metadata is in time-frequency domain, and contains, for example, directions $\theta(k,n)$ and direct-to-total energy ratios $r(k,n)$, where k is the frequency band index and n is the temporal frame index.

FIG. 4 presents a block diagram of the "spatial synthesis". As seen in this figure, the transport audio signals are first transformed to the time-frequency domain using, for instance, short-time Fourier transform (STFT). Also, some other transform may be used, such as quadrature mirror filterbank (QMF). The time-frequency domain audio signals $T_i(k,n)$ (where i is the transport channel index) are divided into ambient and direct parts using the energy ratio $r(k,n)$. The direct part is fed to the "positioning" block, which creates soundbar signals $D_j(k,n)$ (where j is the index of the driver in the soundbar) based on the directions $\theta(k,n)$. When reproduced, this part of audio would be perceived by the listener to originate from the directions described by the direction parameter. The ambient part is fed to the "ambience rendering" block, which creates soundbar signals $A_j(k,n)$. When reproduced, this part of audio would be perceived to be enveloping the listener.

The soundbar signals $D_j(k,n)$ and $A_j(k,n)$ are merged (typically, for example, simply by summing), and the resulting soundbar signals $S_j(k,n)$ are converted to the time domain using an inverse transform (e.g., inverse STFT in the case of STFT). These signals are reproduced by the drivers of the soundbar.

The embodiment of the "positioning" block depends on the type of the soundbar. One possible example, in the case of a soundbar based on beamforming, is presented in FIG. 5. The block receives the direct part of the transport signals $(r(k,n)T_i(k,n))$ and direction parameter $\theta(k,n)$ as an input. Initially, the positioning method to use must be selected. The selection is performed separately for each time-frequency tile (k,n). If the direction parameter $\theta(k,n)$ is pointing to a direction in between the outermost drivers of the soundbar, then the sound can be positioned by using amplitude panning between the drivers of the soundbar (e.g., using vector base amplitude panning (VBAP)). If the direction parameter $\theta(k,n)$ is pointing to a direction outside this arc, then the sound can be positioned using beams.

For example, the soundbar may create beams to such directions, so that after reflecting from the walls, the sound arrives to the listener from angles of 45, −45, 135, and −135 degrees (selecting the beam directions may require calibration of the system). An exemplary beam at 1 kHz simulated with 9 drivers spaced by 12.5 cm is shown in FIG. 6. The soundbar signals realizing the beams are created by multiplying the input signal with filters $H_j(k, \alpha)$ designed to beam the sound to a certain direction $\alpha$, where the change in the direct part of the signal would be determined as follows:

$$D'_j(k,n)=(r(k,n)T_i(k,n))H_j(k,\alpha) \quad (1)$$

The input signal $(r(k,n)T_i(k,n))$ can be selected based on the direction of the beam. E.g., if the beam is on the left, use the left transport channel $T_0(k,n)$ in the case of two transport channels.

Using these beams, the sound can be positioned to the direction of $\theta(k,n)$ by interpolating between the beams. Alternatively, the sound can be positioned by quantizing the direction parameter to the direction of the closest beam.

In some cases, the positioning may also be performed by interpolating between the amplitude-panned signals and beam-positioned signals. For example, if the direction $\theta(k,n)$ is pointing to a direction in between the outermost driver of the soundbar and a beam adjacent to it, the sound can be positioned by interpolating between the reproduction using the outermost driver and the aforementioned beam. The interpolation gains can be obtained, for instance, using amplitude panning (e.g., VBAP).

Finally, the soundbar signals from the amplitude panning and from the beam-based positioning are merged (e.g., by summing), and the resulting signals $D_j(k,n)$ are outputted.

The embodiment of the "ambience rendering" block depends on the type of the soundbar. One possible example, in the case of a soundbar based on beamforming, is presented in FIG. 7. The block receives the ambient part of the transport signals $((1-r(k,n))T_i(k,n))$ as an input. It is assumed that there are two transport channels since the method can be trivially extended to any number of transport channels. For instance, in the case of mobile-device capture, the transport audio signals may be microphone signals selected from the microphones on the opposite sides of the device. As a result, the transport signals may have inherent incoherence, which may be used in the reproduction in order to obtain enhanced envelopment and spaciousness by reproducing them to different directions.

The left channel $((1-r(k,n))T_0(k,n))$ is fed to the "create ambient beam on the left" block. A beam is created in a way that the listener receives the sound via as many reflections as possible and, thus, perceives it as enveloping. Moreover, the main lobe may be to the left. An exemplary beam at 1 kHz simulated with 9 drivers spaced by 12.5 cm is shown in FIG. 8. The beam can be created by multiplying the input signal with filters $H'_j(k, \text{left})$, such that the change in the ambient beam would be determined by the following equation:

$$A'_j=((1-r(k,n))T_0(k,n))H'_j(k,\text{left}) \quad (2)$$

The same procedure is followed for the right channel $((1-r(k,n))T_1(k,n))$, but this part may be reproduced with a beam having the main lobe on the right. Finally, the soundbar signals are merged (e.g., by summing), and the resulting signals $A_j(k,n)$ are outputted.

FIG. 9 illustrates an example of an implementation, which can be implemented with software running inside the soundbar. A bitstream is retrieved from storage or received via network. The bitstream is fed to the "decoder". The decoder demultiplexes the audio signals and the metadata, decoding the audio signals and the metadata. The resulting audio signals and the metadata (e.g., directions and direct-to-total energy ratios) are fed to "spatial synthesis". The "spatial synthesis" works as described above in FIG. 4 and its corresponding text. The result is soundbar signals (i.e., a dedicated signal for each driver of the soundbar). The soundbar signals are forwarded to the drivers which reproduce the signals (typically, there are some components before the actual driver, such as a D/A converter and an amplifier).

FIG. 10 illustrates another example of an implementation, which can be implemented with software running inside a mobile phone or some other external device. A bitstream is retrieved from storage or received via a network. The bitstream is fed to the "decoder". The decoder demultiplexes the audio signals and the metadata, decoding the audio signals and the metadata. The resulting audio signals and the metadata (directions and direct-to-total energy ratios) are fed to "spatial synthesis". The "spatial synthesis" works again as described above in FIG. 4 and its corresponding text. The result is soundbar signals (i.e., a dedicated signal for each driver of the soundbar). The soundbar signals are transmitted to the soundbar (by wire or wirelessly), which reproduces the signals.

FIG. 11 is a logic flow diagram that depicts an exemplary method which is a result of execution of computer program instructions embodied on a computer readable memory, functions performed by logic implemented in hardware, and/or interconnected means for performing functions in accordance with exemplary embodiment. For instance, the functions of the various components described in the embodiments discussed above could perform these steps.

In the first step, audio signals are received. Next, metadata associated with the audio signals is obtained. Thereafter, the audio signals are divided into direct and ambient parts based on the metadata. Finally, spatial audio via a soundbar is rendered based on reproducing the direct part and the ambient part and by merging the reproduced parts.

Without the present invention, the positioning of the audio is suboptimal, since positioning has to be performed via an intermediate format (e.g., 5.1). This can cause directional and timbral artefacts. Without in any way limiting the scope, interpretation, or application of the claims appearing below, an advantage or technical effect of one or more of the exemplary embodiments disclosed herein is that, with the present invention, the positioning is performed directly based on the spatial metadata. The current invention uses a combination of amplitude panning and beamforming based on the spatial metadata. As a result, the soundbar can be optimally used, and directional and timbral accuracy can be optimized.

Without the present invention, the ambience rendering is suboptimal, since it has to be performed via an intermediate format (e.g., 5.1). This typically requires using decorrelation, which in some cases deteriorates the audio quality. Without in any way limiting the scope, interpretation, or application of the claims appearing below, another advantage or technical effect of one or more of the exemplary embodiments disclosed herein is that, with the present invention, the ambience rendering is performed by reproducing the sound with beam patterns that reproduce the audio to the listener with multiple reflections from wall, which means that the decorrelation is not needed and the artifacts caused by decorrelation are avoided.

Moreover, without in any way limiting the scope, interpretation, or application of the claims appearing below, another advantage or technical effect of one or more of the exemplary embodiments disclosed herein is that the present invention optimally uses the potential incoherence of the transport signals by reproducing them to different direction, thus further enhancing the envelopment and spaciousness.

Additionally, the current invention goes beyond the teaching of current understanding.

Although various aspects of the invention are set out in the independent claims, other aspects of the invention comprise other combinations of features from the described embodiments and/or the dependent claims with the features of the independent claims, and not solely the combinations explicitly set out in the claims.

An example of an embodiment of the current invention, which can be referred to as item 1, is a method comprising: receiving audio signals; obtaining metadata associated with the audio signals; dividing the audio signals into direct and ambient parts based on the metadata; and rendering spatial audio via a soundbar based on reproducing the direct part and the ambient part and by merging the reproduced parts.

An example of another embodiment of the current invention, which can be referred to as item 2, is the method of item 1, further comprises: generating at least one transport audio signal based on the received audio signals and/or obtained metadata.

An example of another embodiment of the current invention, which can be referred to as item 3, is the method of item 2, wherein the metadata is a spatial metadata comprising direction parameters and energy ratio parameters for at least two frequency bands.

An example of another embodiment of the current invention, which can be referred to as item 4, is the method of item 3, wherein the energy ratio parameters are direct-to-total energy ratio parameters.

An example of another embodiment of the current invention, which can be referred to as item 5, is the method of item 3, wherein the reproducing of the direct part comprises panning and beamforming based on the direction parameters, wherein panning comprises at least one of: amplitude panning; ambisonic panning; delay panning and any other panning technique so as to position the direct part.

An example of another embodiment of the current invention, which can be referred to as item 6, is the method of item 2, wherein the reproduced the ambient part comprises at least one ambient beam, wherein the at least one ambient beam reproduces at least one transport audio signal.

An example of another embodiment of the current invention, which can be referred to as item 7, is the method of item 6, wherein at least one ambient beam is radiated towards a direction to cause at least one reflection and at least the direct path is attenuated at a listening position where the at least one reflection is received.

An example of another embodiment of the current invention, which can be referred to as item 8, is the method of item 3, wherein the dividing is based on the energy ratio parameters. An example of another embodiment of the current invention, which can be referred to as item 8', is the method of item 3, wherein the reproducing of the direct part is based on the direction parameters.

An example of another embodiment of the current invention, which can be referred to as item 9, is the method of item 8, wherein reproducing the direct part comprises forming at least one beam to at least one ascertained direction so as to perform one of: the direct part is being guided towards the listener directly, the direct part is being guided towards the listener from at least one object around the listener; and the sound for the direct part is positioned by at least one of: interpolating between at least two beams and quantizing the direction parameters to the ascertained directions.

An example of another embodiment of the current invention, which can be referred to as item 10, is the method of item 9, wherein the at least one beam is radiated using at least one transducer of the soundbar based on the direction parameters.

An example of another embodiment of the current invention, which can be referred to as item 11, is the method of item 10, wherein the at least one transducer is selected based on the direction parameters.

An example of another embodiment of the current invention, which can be referred to as item 12, is the method of item 1, wherein reproducing the ambient part comprises creating ambient beams radiating sound via reflections to directions other than a direction of a listener.

An example of another embodiment of the current invention, which can be referred to as item 13, is the method of item 1, wherein the received audio signals comprise at least one of: multichannel signals; loudspeaker signals; audio objects; microphone array signals; and ambisonic signals.

An example of another embodiment of the current invention, which can be referred to as item 14, is the method of item 2, wherein the at least one transport audio signal and associated metadata are able to be at least one of: transmitted, received, stored, manipulated, and processed.

An example of another embodiment of the current invention, which can be referred to as item 15, is the method of item 1, wherein the reproduction and the rendering are associated with soundbar configuration.

An example of another embodiment of the current invention, which can be referred to as item 16, is the method of item 15, further comprising: acquiring information about the soundbar comprising an indication of an arrangement of transducers.

An example of another embodiment of the current invention, which can be referred to as item 16' is the method of item 16, wherein the indication comprises at least one of: directivity and orientation of the transducers.

An example of another embodiment of the current invention, which can be referred to as item 17, is the method of item 5, wherein when panning comprises the amplitude panning, the method comprises: horizontally spacing transducers of the soundbar by a predetermined amount.

An example of another embodiment of the current invention, which can be referred to as item 18, is an apparatus comprising: at least one processor and at least one memory including computer program code, wherein the at least one memory and the computer code are configured, with the at least one processor, to cause the apparatus to at least perform the following: receiving audio signals; obtaining metadata associated with the audio signals; dividing the audio signals into direct and ambient parts based on the metadata; and rendering spatial audio via a soundbar based on reproducing the direct part and the ambient part and by merging the reproduced parts.

FIG. 12 is a block diagram of an exemplary apparatus in accordance with an exemplary embodiment. This figure is an example of the apparatus of item 18 (and other apparatuses). The apparatus comprises at least one processor (e.g., "Processor(s)") and at least one memory (e.g., "Memory(ies)"). The at least one memory includes computer program code (e.g., "Computer Program Code"). The at least one memory and the computer code are configured, with the at least one processor, to cause the apparatus to the operations described herein, e.g., in any of FIGS. 2-11 and corresponding text.

An example of another embodiment of the current invention, which can be referred to as item 19, is the apparatus of item 18, wherein the at least one memory and the computer code are further configured, with the at least one processor, to cause the apparatus to at least perform the following: generating at least one transport audio signal based on the received audio signals and/or obtained metadata.

An example of another embodiment of the current invention, which can be referred to as item 20, is the apparatus of item 19, wherein the metadata is a spatial metadata comprising direction parameters and energy ratio parameters for at least two frequency bands.

An example of another embodiment of the current invention, which can be referred to as item 21, is the apparatus of item 20, wherein the energy ratio parameters are direct-to-total energy ratio parameters.

An example of another embodiment of the current invention, which can be referred to as item 22, is the apparatus of item 20, wherein the reproducing of the direct part comprises panning and beamforming based on the direction parameters, wherein panning comprises at least one of: amplitude panning; ambisonic panning; delay panning and any other panning technique so as to position the direct part.

An example of another embodiment of the current invention, which can be referred to as item 23, is the apparatus of item 19, wherein the reproduced the ambient part comprises at least one ambient beam, wherein the at least one ambient beam reproduces at least one transport audio signal.

An example of another embodiment of the current invention, which can be referred to as item 24, is the apparatus of item 23, wherein at least one ambient beam is radiated towards a direction to cause at least one reflection and at least the direct path is attenuated at a listening position where the at least one reflection is received.

An example of another embodiment of the current invention, which can be referred to as item 25, is the apparatus of item 20, wherein the dividing is based on the energy ratio parameters. An example of another embodiment of the current invention, which can be referred to as item 25', is the apparatus of item 20, wherein the reproducing of the direct part is based on the direction parameters.

An example of another embodiment of the current invention, which can be referred to as item 26, is the apparatus of item 25, wherein reproducing the direct part comprises forming at least one beam to at least one ascertained direction so as to perform one of: the direct part is being guided towards the listener directly, the direct part is being guided towards the listener from at least one object around the listener; and the sound for the direct part is positioned by at least one of: interpolating between at least two beams and quantizing the direction parameters to the ascertained directions.

An example of another embodiment of the current invention, which can be referred to as item 27, is the apparatus of item 26, wherein the at least one beam is radiated using at least one transducer of the soundbar based on the direction parameters.

An example of another embodiment of the current invention, which can be referred to as item 28, is the apparatus of item 27, wherein the at least one transducer is selected based on the direction parameters.

An example of another embodiment of the current invention, which can be referred to as item 29, is the apparatus of item 18, wherein reproducing the ambient part comprises creating ambient beams radiating sound via reflections to directions other than a direction of a listener.

An example of another embodiment of the current invention, which can be referred to as item 30, is the apparatus of item 18, wherein the received audio signals comprise at least one of: multichannel signals; loudspeaker signals; audio objects; microphone array signals; and ambisonic signals.

An example of another embodiment of the current invention, which can be referred to as item 31, is the apparatus of item 19, wherein the at least one transport audio signal and associated metadata are able to be at least one of: transmitted, received, stored, manipulated, and processed.

An example of another embodiment of the current invention, which can be referred to as item 32, is the apparatus of item 18, wherein the reproduction and the rendering are associated with soundbar configuration.

An example of another embodiment of the current invention, which can be referred to as item 33, is the apparatus of item 32, wherein the at least one memory and the computer code are further configured, with the at least one processor, to cause the apparatus to at least perform the following: acquiring information about the soundbar comprising an indication of an arrangement of transducers.

An example of another embodiment of the current invention, which can be referred to as item 33', is the apparatus of item 33, wherein the indication comprises at least one of: directivity and orientation of the transducers.

An example of another embodiment of the current invention, which can be referred to as item 34, is the apparatus of item 22, wherein, when panning comprises the amplitude panning, the at least one memory and the computer code are further configured, with the at least one processor, to cause the apparatus to at least perform the following: horizontally spacing transducers of the soundbar by a predetermined amount.

An example of another embodiment of the current invention, which can be referred to as item 35, is a computer program product embodied on a non-transitory computer-readable medium in which a computer program is stored that, when being executed by a computer, is configured to provide instructions to control or carry out: receiving audio signals; obtaining metadata associated with the audio signals; dividing the audio signals into direct and ambient parts based on the metadata; and rendering spatial audio via a soundbar based on reproducing the direct part and the ambient part and by merging the reproduced parts.

An example of another embodiment of the current invention, which can be referred to as item 36, is a computer program that comprises code for controlling or performing the method of any of items 1-17.

An example of another embodiment of the current invention, which can be referred to as item 37, where a computer program product comprises a computer-readable medium bearing the computer program code of item 36 embodied therein for use with a computer.

An example of another embodiment of the current invention, which can be referred to as item 38, is a computer program product embodied on a non-transitory computer-readable medium in which a computer program is stored that, when being executed by a computer, is configured to provide instructions comprising code for receiving audio signals; code for obtaining metadata associated with the audio signals; code for dividing the audio signals into direct and ambient parts based on the metadata; and code for rendering spatial audio via a soundbar based on reproducing the direct part and the ambient part and by merging the reproduced parts.

An example of another embodiment of the current invention, which can be referred to as item 39, is an apparatus, comprising means for receiving audio signals; means for obtaining metadata associated with the audio signals; means for dividing the audio signals into direct and ambient parts based on the metadata; and means for rendering spatial audio via a soundbar based on reproducing the direct part and the ambient part and by merging the reproduced parts.

Item 40 is an apparatus comprising: means for receiving audio signals; means for obtaining metadata associated with the audio signals; means for dividing the audio signals into direct and ambient parts based on the metadata; and means for rendering spatial audio via a soundbar based on reproducing the direct part and the ambient part and by merging the reproduced parts.

Item 41 is the apparatus of item 40, further comprising: means for generating at least one transport audio signal based on the received audio signals and/or obtained metadata.

Item 42 is the apparatus of item 41, wherein the metadata is a spatial metadata comprising direction parameters and energy ratio parameters for at least two frequency bands.

Item 43 is the apparatus of item 42, wherein the energy ratio parameters are direct-to-total energy ratio parameters.

Item 44 is the apparatus of item 42, wherein the reproducing of the direct part comprises panning and beamforming based on the direction parameters, wherein panning comprises at least one of: amplitude panning; ambisonic panning; delay panning and any other panning technique so as to position the direct part.

Item 45 is the apparatus of item 41, wherein the reproduced the ambient part comprises at least one ambient beam, wherein the at least one ambient beam reproduces at least one transport audio signal.

Item 46 is the apparatus of item 45, wherein at least one ambient beam is radiated towards a direction to cause at least one reflection and at least the direct path is attenuated at a listening position where the at least one reflection is received.

Item 47 is the apparatus of item 42, wherein the dividing is based on the energy ratio parameters, and wherein the reproducing of the direct part is based on the direction parameters.

Item 48 is the apparatus of item 47, wherein reproducing the direct part comprises forming at least one beam to at least one ascertained direction so as to perform one of:

the direct part is being guided towards the listener directly, the direct part is being guided towards the listener from at least one object around the listener; and the sound for the direct part is positioned by at least one of: interpolating between at least two beams and quantizing the direction parameters to the ascertained directions.

Item 49 is the apparatus of item 48, wherein the at least one beam is radiated using at least one transducer of the soundbar based on the direction parameters.

Item 50 is the apparatus of item 49, wherein the at least one transducer is selected based on the direction parameters.

Item 51 is the apparatus of item 40, wherein the received audio signals comprise at least one of:

multichannel signals;

loudspeaker signals;

audio objects;

microphone array signals; and ambisonic signals.

Item 52 is the apparatus of item 41, wherein the at least one transport audio signal and associated metadata are able to be at least one of: transmitted, received, stored, manipulated, and processed.

Item 53 is the apparatus of item 40, wherein the reproduction and the rendering are associated with soundbar configuration.

Item 54 is the apparatus of item 53, further comprising: means for acquiring information about the soundbar comprising an indication of an arrangement of transducers.

Item 55 is the apparatus of item 44, wherein when panning comprises the amplitude panning, the apparatus comprises: means for horizontally spacing transducers of the soundbar by a predetermined amount.

If desired, the different functions discussed herein may be performed in a different order and/or concurrently with each other. Furthermore, if desired, one or more of the above-described functions may be optional or may be combined.

It is also noted herein that while the above describes examples of embodiments of the invention, these descriptions should not be viewed in a limiting sense. Rather, there are several variations and modifications which may be made without departing from the scope of the present invention as defined in the appended claims.

What is claimed is:

1. A method comprising:

receiving audio signals;

obtaining metadata associated with the received audio signals;

dividing the received audio signals into direct and ambient parts based on the obtained metadata, wherein the dividing is based at least on energy ratio parameters in the obtained metadata, and wherein the direct part comprises information to render sounds to certain directions and the ambient part comprises information to render sounds to other directions; and rendering spatial audio via a soundbar based on reproducing the direct part and the ambient part and by merging the reproduced parts.

2. The method of claim 1, further comprising generating at least one transport audio signal based on at least one of the received audio signals or the obtained metadata.

3. The method of claim 2, wherein the obtained metadata is spatial metadata comprising direction parameters and the energy ratio parameters for at least two frequency bands, and wherein the energy ratio parameters are direct-to-total energy ratio parameters.

4. The method of claim 3, wherein the reproducing of the direct part comprises palming and beamforming based on the direction parameters, wherein panning comprises at least one of the following: amplitude palming; ambisonic panning; delay panning; or any other panning technique so as to position the direct part.

5. The method of claim 4, wherein when panning comprises the amplitude palming, and the amplitude panning comprises outputting signals with predetermined amplitudes for horizontally spaced transducers of the soundbar.

6. The method of claim 3, wherein the reproducing of the direct part is based on the direction parameters.

7. The method of claim 6, wherein reproducing of the direct part comprises forming at least one beam to at least one ascertained direction so as to perform one of the following:

the direct part being guided towards a listener directly, the direct part being guided towards the listener from at least one object around the listener; or sound for the direct part is positioned by at least one of the following: interpolating between at least two beams or quantizing the direction parameters to the at least one ascertained direction.

8. The method of claim 7, further comprising at least one of:

radiating the at least one beam using at least one transducer of the soundbar based on the direction parameters; or selecting the at least one transducer of the soundbar based on the direction parameters.

9. The method of claim 2, wherein the reproducing of the ambient part forms at least one ambient beam, wherein the at least one ambient beam is at least one of the following: reproducing the at least one transport audio signal; or radiating towards a direction to cause at least one reflection so as to attenuate at least a direct path at a listening position where the at least one reflection is received.

10. The method of claim 1, further comprising at least one of:

associating the reproducing and the rendering with soundbar configuration; or acquiring information about the soundbar comprising an indication of an arrangement of transducers of the soundbar.

11. An apparatus comprising:

at least one processor and at least one memory including computer program code, wherein the at least one memory and the computer code are configured, with the at least one processor, to cause the apparatus to at least:

receive audio signals;

obtain metadata associated with the received audio signals;

divide the received audio signals into direct and ambient parts based on the obtained metadata, wherein the dividing is based at least on energy ratio parameters in the obtained metadata; and render spatial audio via a soundbar based on reproducing the direct part and the ambient part and by merging the reproduced parts.

12. The apparatus of claim 11, wherein the at least one memory and the computer code are further configured, with the at least one processor, to cause the apparatus to: generate at least one transport audio signal based on at least one of the received audio signals or obtained metadata.

13. The apparatus of claim 12, wherein the metadata is spatial metadata comprising direction parameters and the energy ratio parameters for at least two frequency bands, and wherein the energy ratio parameters are direct-to-total energy ratio parameters.

14. The apparatus of claim 13, wherein the reproducing of the direct part comprises panning and beamforming based on the direction parameters, wherein panning comprises at least one of the following: amplitude panning; ambisonic panning; delay panning; or any other panning technique so as to position the direct part.

15. The apparatus of claim 14, wherein when panning comprises the amplitude panning, and the amplitude panning comprises outputting predetermined amplitudes for signals for horizontally spaced transducers of the soundbar.

16. The apparatus of claim 13, wherein the dividing is based on the energy ratio parameters, and wherein the reproducing of the direct part is based on the direction parameters.

17. The apparatus of claim 16, wherein the reproducing of the direct part comprises forming at least one beam to at least one ascertained direction so as to perform one of the following:

the direct part being guided towards a listener directly;

the direct part being guided towards the listener from at least one object around the listener; or sound for the direct part is positioned by at least one of the following: interpolating between at least two beams and quantizing the direction parameters to the at least one ascertained direction.

18. The apparatus of claim 17, wherein the at least one memory and the computer code are further configured, with the at least one processor, to cause the apparatus to:

radiate the at least one beam from at least one transducer of the soundbar based on the direction parameters; and select the at least one transducer of the soundbar based on the direction parameters.

19. The apparatus of claim 11, wherein the at least one memory and the computer code are further configured, with the at least one processor, to cause the apparatus to:

reproduce and render according to soundbar configuration; and acquire information about the soundbar comprising an indication of an arrangement of transducers of the soundbar.

20. An apparatus comprising:

at least one processor and at least one memory including computer program code, wherein the at least one memory and the computer code are configured, with the at least one processor, to cause the apparatus to at least:

receive audio signals;

obtain metadata associated with the received audio signals;

divide the received audio signals into direct and ambient parts based on the obtained metadata;

generate at least one transport audio signal based on at least one of the received audio signals or the obtained metadata; and render spatial audio via a soundbar based on reproducing the direct part and the ambient part and by merging the reproduced parts, wherein the reproducing of the ambient part forms at least one ambient beam, wherein the at least one ambient beam is at least one of the following: reproducing the at least one transport audio signal; or radiating towards a direction to cause at least one reflection so that at least a direct path is attenuated at a listening position where the at least one reflection is received.

* * * * *